US010111517B2

(12) United States Patent
Lin

(10) Patent No.: US 10,111,517 B2
(45) **Date of Patent: *Oct. 30, 2018**

(54) COLLAPSIBLE BISTRO TABLE

(71) Applicant: Zhuhai Shichang Metals Ltd., Zhuhai (CN)

(72) Inventor: Wen-Sheng Lin, Kaohsiung (TW)

(73) Assignee: Zhuhai Shichang Metals Ltd (CN)

( * ) Notice: Subject to any disclaimer, the term of this patent is extended or adjusted under 35 U.S.C. 154(b) by 0 days.

This patent is subject to a terminal disclaimer.

(21) Appl. No.: 15/439,039

(22) Filed: Feb. 22, 2017

(65) Prior Publication Data

US 2017/0188697 A1 Jul. 6, 2017

Related U.S. Application Data

(63) Continuation-in-part of application No. 15/002,517, filed on Jan. 21, 2016, now Pat. No. 9,609,943, which (Continued)

(51) Int. Cl.

| | |
|---|---|
| ***A47B 3/02*** | (2006.01) |
| ***A47C 11/00*** | (2006.01) |
| ***A47C 4/14*** | (2006.01) |
| ***A47C 4/24*** | (2006.01) |
| *A47B 3/08* | (2006.01) |

(52) U.S. Cl.

CPC ..... *A47B 3/02* (2013.01); *A47C 4/14* (2013.01); *A47C 4/24* (2013.01); *A47C 11/00* (2013.01); *A47B 2003/025* (2013.01); *A47B 2003/0821* (2013.01); *A47B 2003/0827* (2013.01)

(58) Field of Classification Search

CPC ..... A47B 3/02; A47B 2003/25

USPC ..... 108/118, 119, 120, 115, 116, 125, 129; 248/423, 157, 164, 439, 168, 188.1, 248/188.2, 188.6; 182/154, 155; 297/4, 297/55, 345, 310, 56

See application file for complete search history.

(56) References Cited

U.S. PATENT DOCUMENTS 906,382 A * 12/1908 Carrier ..... A47B 9/16 108/116
2,053,789 A * 9/1936 Hardy ..... A47B 3/0915 108/124

(Continued)

FOREIGN PATENT DOCUMENTS

| | | |
|---|---|---|
| CN | 200320107316.8 | 11/2003 |
| GB | 2501717 | * 11/2013 |
| WO | 03/059119 | * 7/2003 |

*Primary Examiner* — Janet M Wilkens

(74) *Attorney, Agent, or Firm* — Luedeka Neely Group, PC

(57) ABSTRACT

A collapsible table includes a tabletop, a first pair of collapsible legs, and a second pair of collapsible legs. The first pair of legs includes a first support bar for connecting a first leg to a second leg adjacent their top end portions, and the first support bar is pivotally connected to the bottom surface of the tabletop. The second pair of legs includes a second support bar for connecting a third leg to a fourth leg and a third support bar spaced apart from the second support bar for connecting the third leg to the fourth leg. One or more brackets are disposed adjacent the bottom surface of the tabletop and are positioned and configured to removably secure the second support bar to the bottom surface of the tabletop in a use position and removably secure the third support bar to the bottom surface in a storage position.

17 Claims, 17 Drawing Sheets

Related U.S. Application Data is a continuation-in-part of application No. 29/550,499, filed on Jan. 5, 2016, now Pat. No. Des. 775,877.

(56) References Cited

U.S. PATENT DOCUMENTS

| | | | | | |
|---|---|---|---|---|---|
| 2,675,286 | A | | 4/1954 | Derman | |
| 2,871,075 | A | * | 1/1959 | Stone | A47B 3/02 108/119 |
| 2,912,775 | A | * | 11/1959 | Gettelman | D06F 81/04 108/117 |
| 3,103,900 | A | * | 9/1963 | Lippman | A47B 3/02 108/10 |
| 4,168,669 | A | * | 9/1979 | Arnoff | A47B 3/12 108/116 |
| 5,483,901 | A | * | 1/1996 | Tisbo | A47B 3/02 108/119 |
| 6,213,555 | B1 | * | 4/2001 | Sulpizio | A47C 1/143 108/116 |
| 6,912,961 | B2 | * | 7/2005 | Winter | A47B 9/16 108/116 |
| D606,845 | S | * | 12/2009 | Taatjes | D8/358 |
| 7,640,869 | B2 | * | 1/2010 | Leng | A47B 3/02 108/116 |
| D618,936 | S | * | 7/2010 | Xu | D6/691.6 |
| 2003/0164121 | A1 | | 9/2003 | Winter et al. | |
| 2006/0191447 | A1 | * | 8/2006 | Ashby | A47B 3/02 108/119 |
| 2009/0000528 | A1 | * | 1/2009 | Leng | A47B 3/06 108/156 |
| 2010/0186640 | A1 | * | 7/2010 | Leng | A47B 3/02 108/119 |

* cited by examiner

COLLAPSIBLE BISTRO TABLE

CROSS REFERENCE TO RELATED APPLICATION

This application claims priority as a continuation-in-part of co-pending U.S. patent application Ser. No. 15/002,517 filed on Jan. 21, 2016, titled "Collapsible Bistro Table," which is a continuation-in-part of U.S. patent application Ser. No. 29/550,499 filed on Jan. 5, 2016, which issued as U.S. Design Pat. No. D775,877 on Jan. 10, 2017. The entire contents of the prior applications are incorporated herein by reference.

FIELD

The present disclosure relates to collapsible tables and other collapsible supporting structures. More particularly, the present disclosure relates to a bistro table that can be collapsed into a compact position with the legs secured to the bottom surface of the table when not in use, thereby allowing easy storage, package and transportation of the table.

BACKGROUND

A conventional folding or collapsible table is available for providing a support surface in a use position while taking up less space in a storage position. However, particularly in the case of smaller tables in which the supporting legs are generally longer than the width or length of the table surface, the legs are often an inconvenience in storage, package, and transportation because the legs must awkwardly and loosely extend from the table surface in the storage position (e.g., it is difficult to keep the legs in their storage positions). While one solution has been to wrap a rope or cord around one or more table surfaces to secure the legs to the bottom surface of the tables, this requires an undesired extra step, which adds time to packing and storing multiple tables at a time.

What is needed therefore is a table that can be easily moved between a use and storage position where the legs are easily secured to the bottom surface of the table when not in use, thereby allowing easy storage, package and transportation of the table.

SUMMARY

According to one embodiment of the disclosure, a collapsible table includes a tabletop having a width and comprising a top surface and a bottom surface opposite the top surface. A first pair of collapsible legs includes a first leg and a second leg, both having top end portions. A second pair of collapsible legs includes a third leg and a fourth leg, both having top end portions. The first, second, third, and fourth legs have a length that is greater than the width of the tabletop. The first and second pairs of collapsible legs can move to a use position in which the legs extend from the bottom surface of the tabletop to support the tabletop. The first and second pairs of collapsible legs can also move to a storage position in which the top end portion of each leg is disposed adjacent to the bottom surface of the tabletop. A first support bar is pivotally connected to the bottom surface of the tabletop and connects the first leg to the second leg adjacent their top end portions. A second support bar connects the third leg to the fourth leg adjacent their top end portions. A third support bar is spaced apart from the second support bar and connects the third leg to the fourth leg. One or more brackets adjacent the bottom surface of the tabletop are positioned and configured to removably secure the second support bar adjacent the bottom surface of the tabletop in the use position. The same one or more brackets removably secure the third support bar adjacent the bottom surface of the tabletop in the storage position.

In some embodiments, the bottom surface of the tabletop includes first and second receiving channels for receiving the legs when they are in the storage position. The first receiving channel receives the first and third legs below their top end portions in the storage position. The second receiving channel receives the second and fourth legs below their top end portions in the storage position.

In various embodiments, the top surface of the tabletop may have a shape that is rectangular, square, oval, elliptical, circular, or irregular.

In some embodiments, the tabletop is formed from blow-molded plastic. In those embodiments, the one or more brackets are integrally formed from the blow-molded plastic of the tabletop.

In some embodiments, the one or more brackets include first and second sets of brackets. The first set of brackets receives a first portion of the second or third support bar. The second set of brackets receives a second portion of the second or third support bar.

In some embodiments, the one or more brackets are configured to prevent any substantial movement of the second and third support bars in the respective use and storage positions.

In some embodiments, the second pair of collapsible legs is pivotally connected to the first pair of collapsible legs.

In some embodiments, the first support bar is substantially non-removably secured to the bottom surface of the tabletop.

In another aspect, embodiments described herein provide a collapsible supporting structure. The collapsible supporting structure includes a top structure having a width and comprising a top surface and a bottom surface opposite the top surface. A first pair of collapsible legs includes a first leg and a second leg, both having a top end portion. Each of the top end portions of the first and second legs are pivotally connected to the bottom surface of the top structure. A second pair of collapsible legs includes a third leg and a fourth leg, both having a top end portion. The first, second, third, and fourth legs have a length that is greater than the width of the top structure. The first and second pairs of collapsible legs can move to a use position in which the legs extend from the bottom surface of the top structure to support the top structure. The first and second pairs of collapsible legs can also move to a storage position in which at least the top end portions of each of the legs are disposed adjacent to the bottom surface of the top structure. A first support bar connects the third leg to the fourth leg adjacent their top end portions. A second support bar, spaced apart from the first support bar, connects the third leg to the fourth leg. One or more brackets are disposed adjacent the bottom surface of the top structure. The one or more brackets removably secure the first support bar adjacent the bottom surface of the top structure in the use position. The same one or more brackets removably secure the second support bar adjacent the bottom surface of the top structure in the storage position.

In various embodiments, the top structure may be a tabletop, a tray, a chair seat, a bench seat, a stool seat, or a step-ladder platform.

BRIEF DESCRIPTION OF THE DRAWINGS

Further advantages of the invention are apparent by reference to the detailed description in conjunction with the figures, wherein elements are not to scale so as to more clearly show the details, wherein like reference numbers indicate like elements throughout the several views, and wherein.

DETAILED DESCRIPTION

Figure 1:
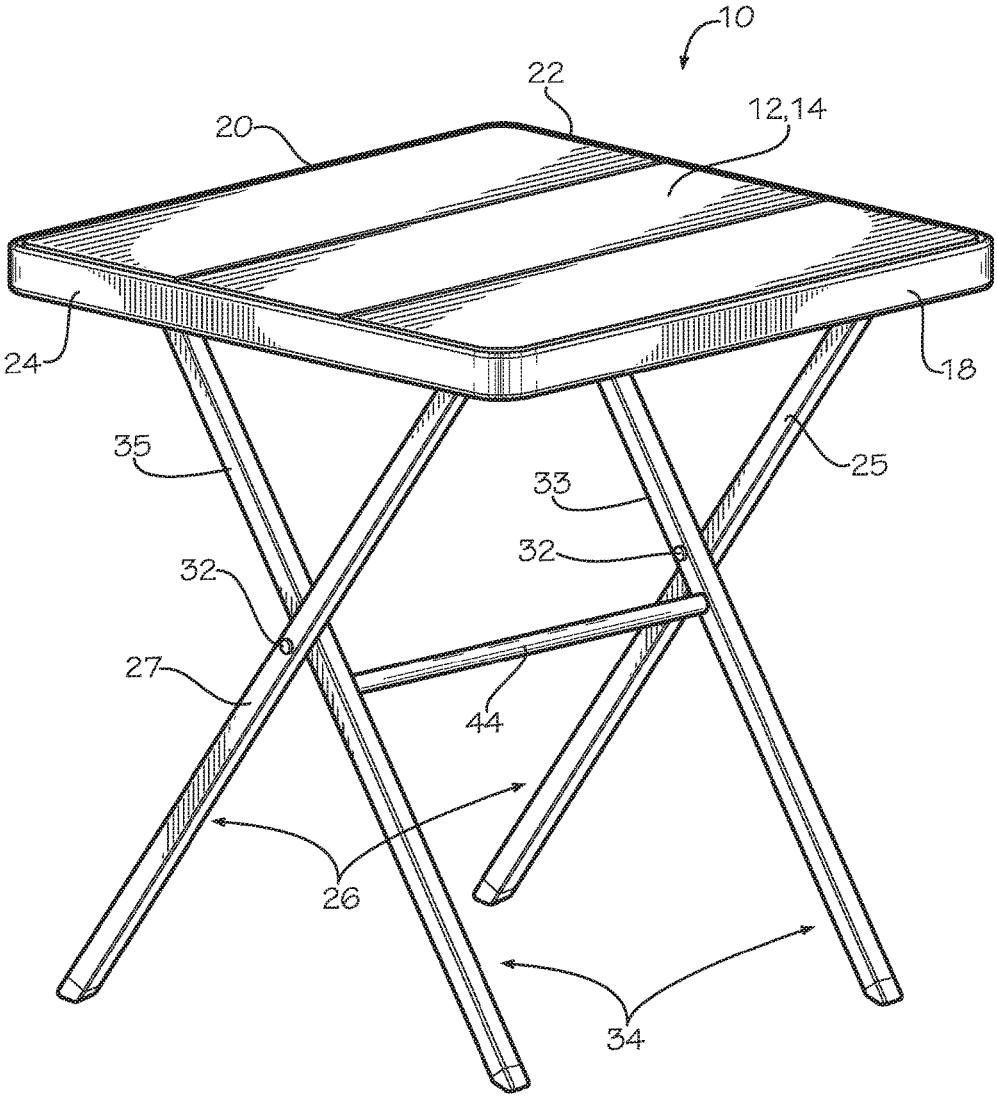
FIG. 1 is a top perspective view of a collapsible table in a use position in accordance with one embodiment of the present disclosure.
Figure 2:
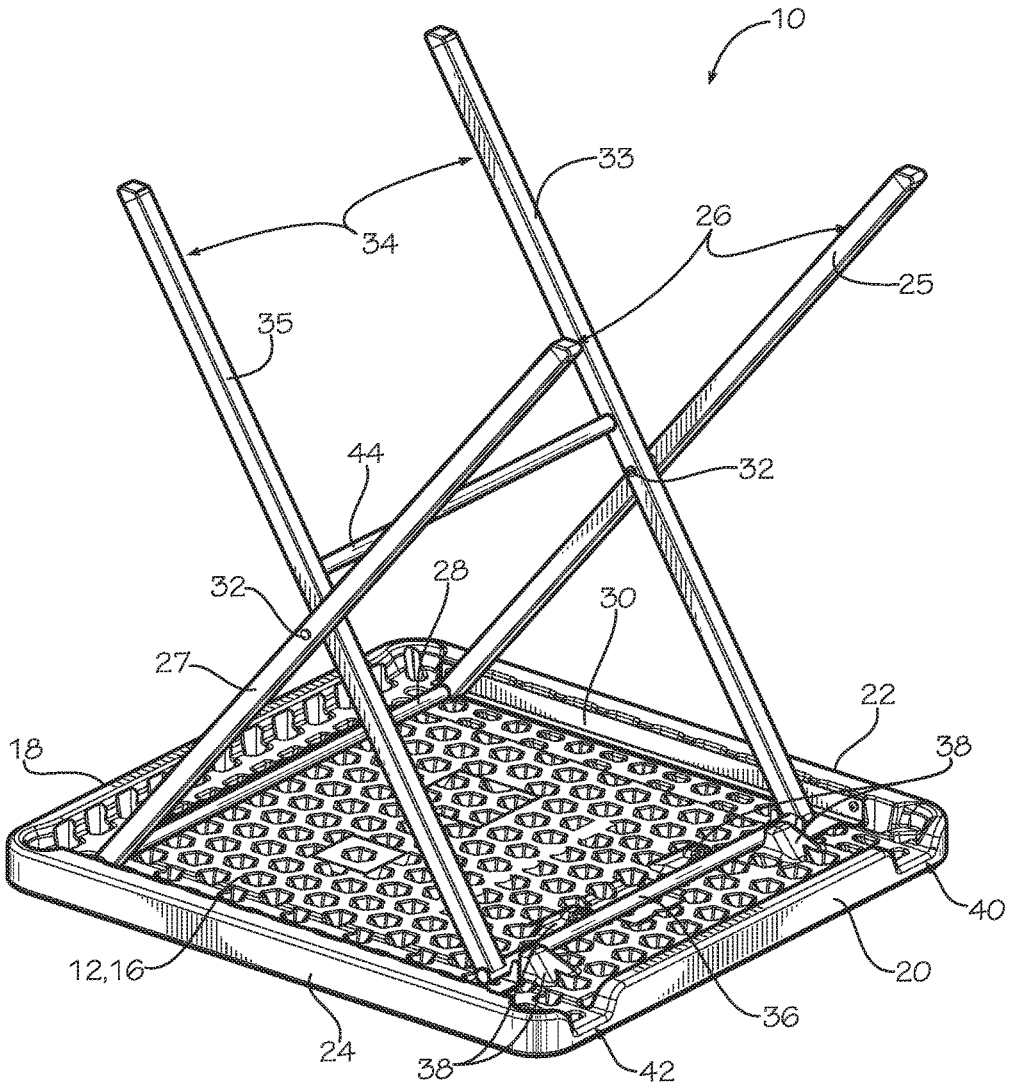
FIG. 2 is a bottom perspective view of the collapsible table in the use position in accordance with one embodiment of the present disclosure.
Figure 3:
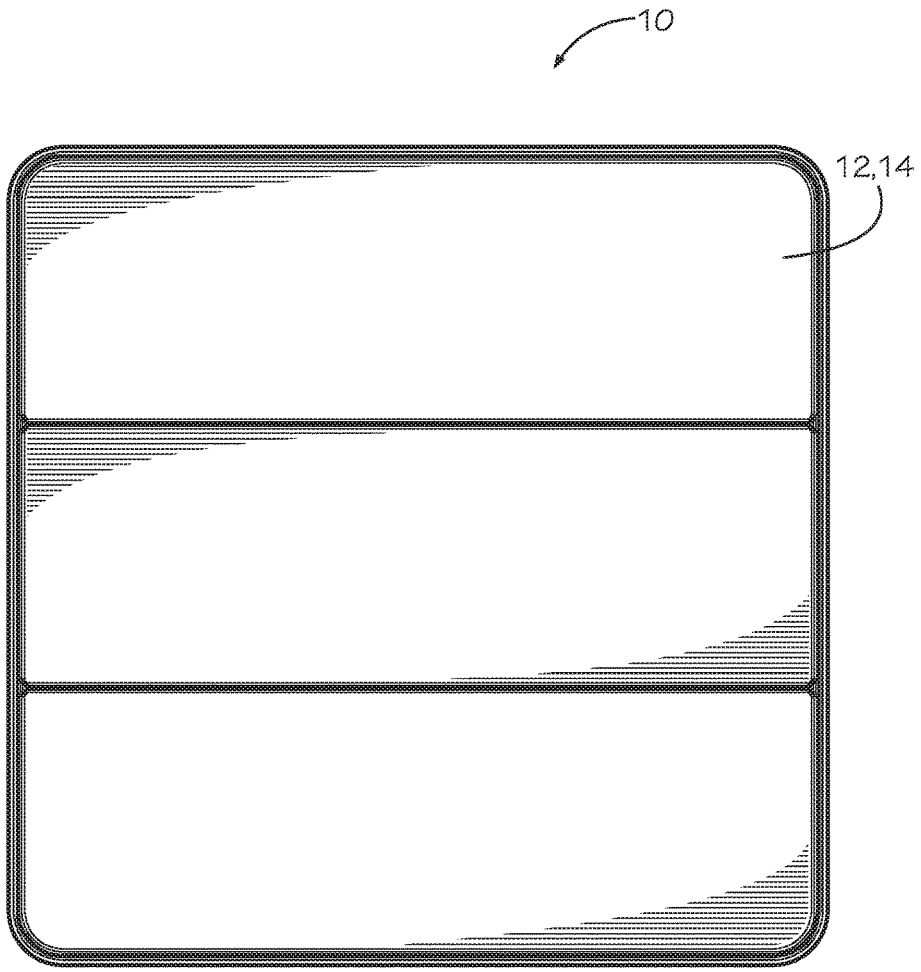
FIG. 3 is a top plan view of the collapsible table in the use position in accordance with one embodiment of the present disclosure.

Referring to FIGS. 1-16, a collapsible table 10 in accordance with the preferred embodiment of the present disclosure includes a tabletop 12 having a planar top surface 14, a bottom surface 16 opposite the top surface 14, a first end 18, a second end 20 opposite the first end 18, a first side 22, and a second side 24 opposite the first side 22. In one embodiment, the shape of the tabletop 12 is substantially square with a width W. In other embodiments, the tabletop 12 is rectangular, oval, circular, elliptical or irregular shaped. The tabletop 12 is preferably formed from blow-molded plastic.

As shown best in FIGS. 2, 4, 10, and 12, the collapsible table 10 further includes a first pair of collapsible legs 26 having a first leg 25 and a second leg 27 secured to each other adjacent their top ends by a support bar 28. In order to move the first pair of collapsible legs 26 between a use position (as shown in FIGS. 1-8) and a storage position (as shown in FIGS. 9-16), the support bar 28 is pivotally connected to the bottom surface 16 of the tabletop 12, preferably adjacent to the first end 18. The particular type of pivotal connection is not critical as long as it provides means for the first pair of collapsible legs 26 to be rotated between use and storage positions as explained below. In certain embodiments shown in FIGS. 2, 4, 10, and 12, the pivotal connection includes hinge pins (not shown) extending from opposite ends of the support bar 28 that rotatably connect to frame members 30 disposed adjacent to the first side 22 and second side 24 of the bottom surface 16 of tabletop 12. Alternatively, support bar 28 is secured within one or more cylindrical receivers formed in the bottom surface 16 that allow for rotation of the support bar 28 in relation to the bottom surface 16 of the tabletop 12.

In an alternative embodiment, there is no support bar disposed between the top ends of the first leg 25 and the second leg 27. In such an embodiment, the top ends of the first and second legs 25 and 27 are pivotally attached to the frame members 30 or to another pivotal connection structure on the bottom surface 16 of the tabletop 12.

Figure 4:
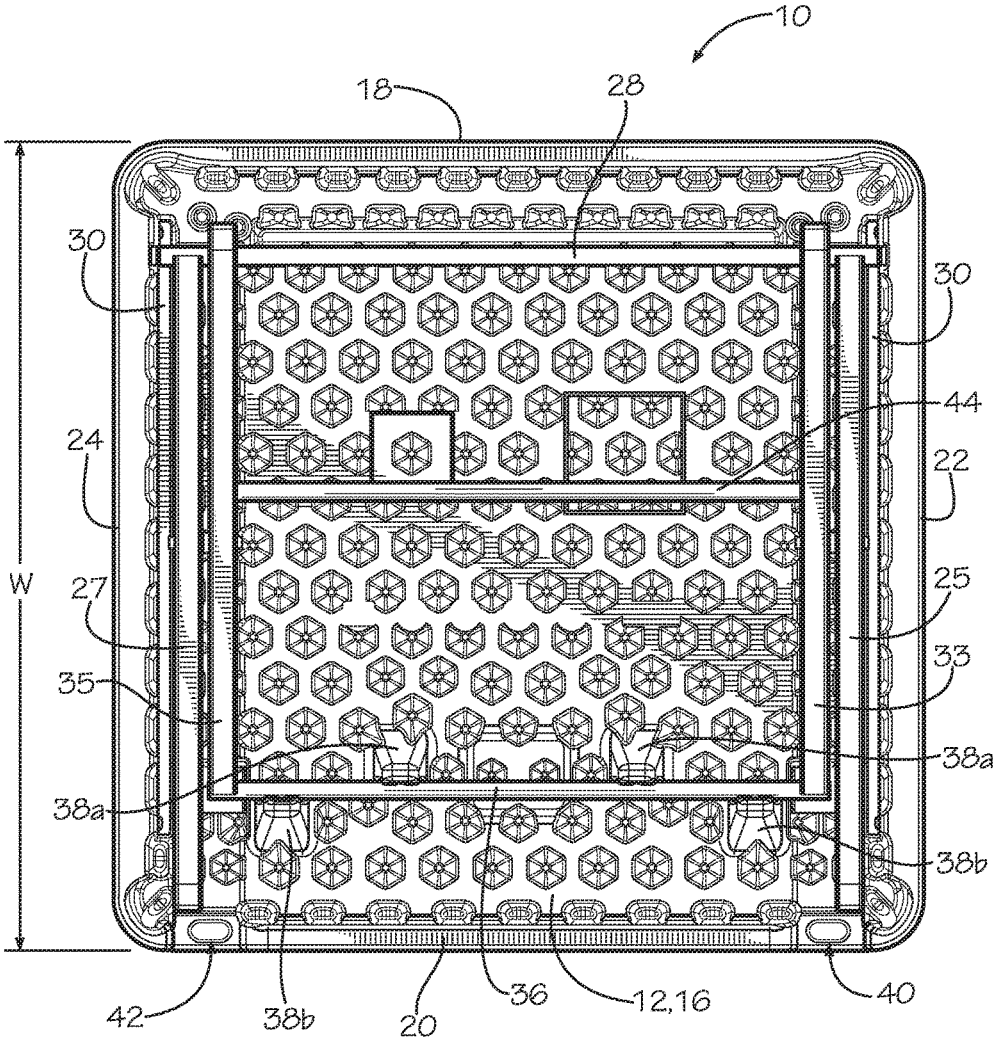
FIG. 4 is a bottom plan view of the collapsible table in the use position in accordance with one embodiment of the present disclosure.
Figure 5:
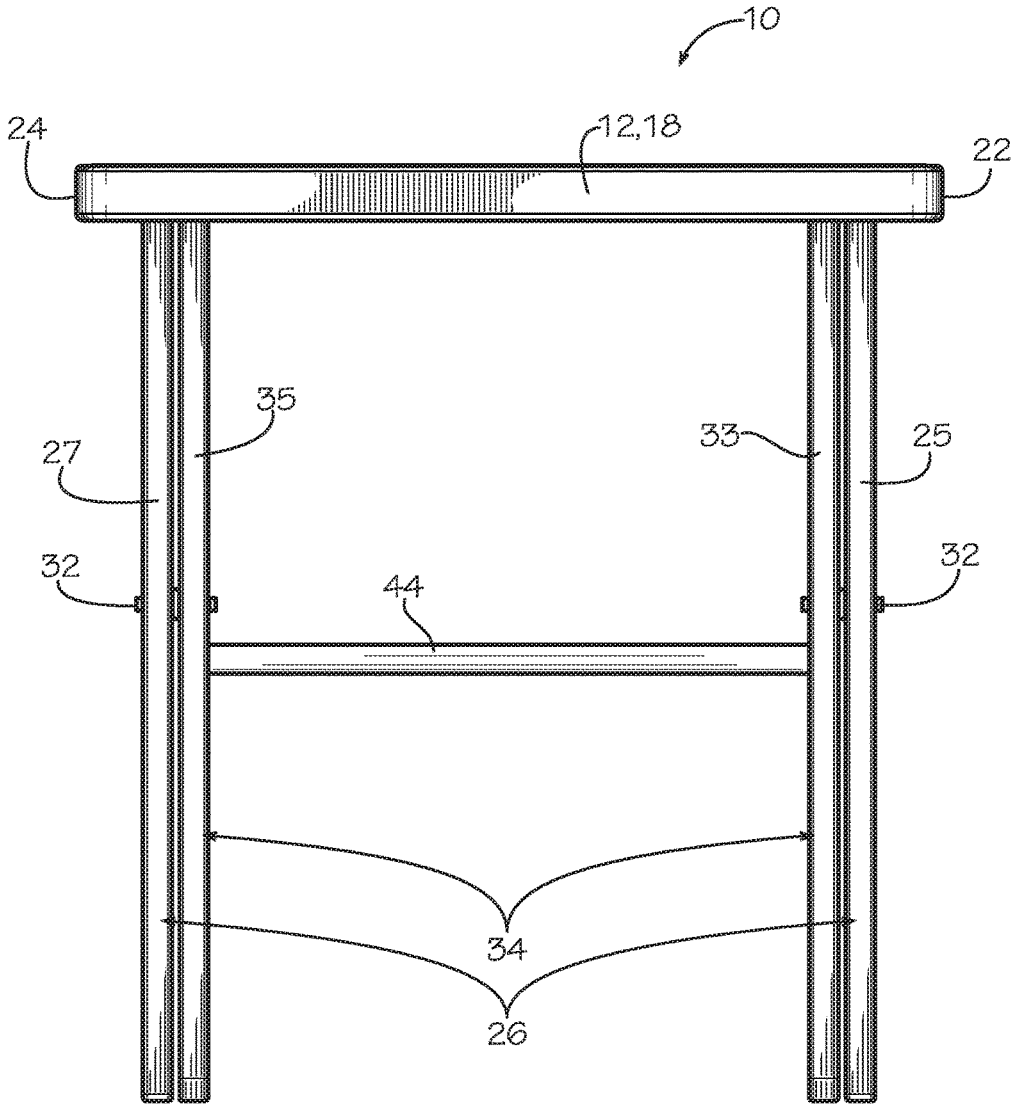
FIG. 5 is a front elevation view of the collapsible table in the use position in accordance with one embodiment of the present disclosure.
Figure 6:
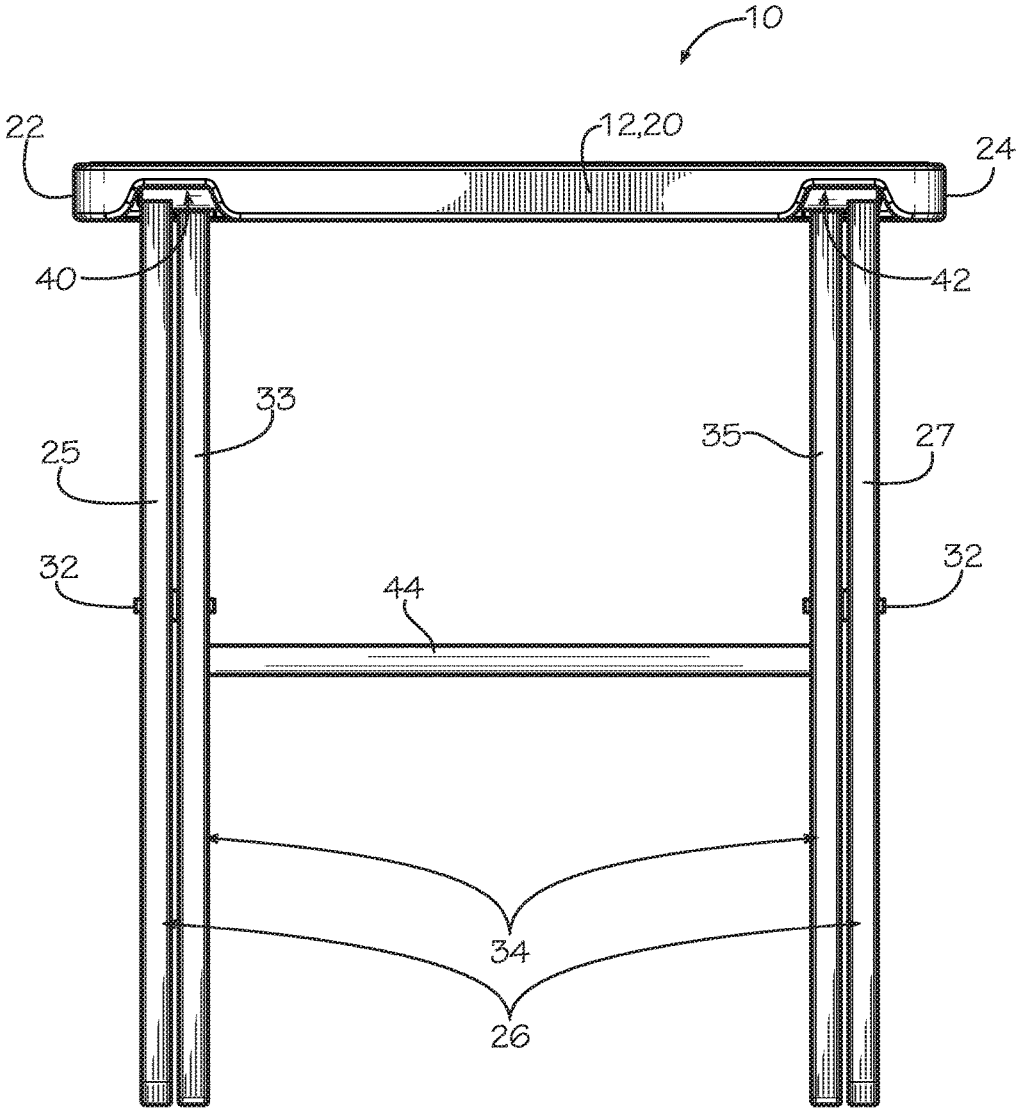
FIG. 6 is a rear elevation view of the collapsible table in the use position in accordance with one embodiment of the present disclosure.

A second pair of collapsible legs 34 having a third leg 33 and a fourth leg 35 are secured to each other adjacent their top ends by a support bar 36. While the first pair of collapsible legs 26 are preferably non-removably secured adjacent the first end 18 of tabletop 12 as explained above, the second pair of collapsible legs 34 are preferably operable to be removably secured to the bottom surface 16 of tabletop 12 adjacent to the second end 20. In order to removably secure the second pair of collapsible legs 34, the bottom surface 16 includes one or more appropriately positioned and configured brackets 38 that together operate to securely receive and release the support bar 36 as desired. It is noted that the brackets 38 are configured so as to not permit any substantial rotation of the support bar 36 when it is received within the brackets 38. In preferred embodiments, the brackets 38 are molded into the bottom surface 16 of the tabletop 12 and each include cylindrical receiving surfaces dimensioned and configured to receive a portion of the cylindrical support bar 36 in the use position. Referring to FIG. 4, in preferred embodiments, the bottom surface 16 includes a first set of brackets 38*a* positioned to receive one side of the support bar 36 in the use position and a second set of brackets 38*b* positioned to receive the other side of the support bar 36. Together, brackets 38*a* and 38*b* provide a "snap-fit" when inserting the support bar 36 into the brackets to secure the second pair of collapsible legs 34 to the bottom surface 16 of the tabletop 12. In alternative embodiments, each of the brackets 38 are horizontally aligned and each include cylindrical tabs dimensioned and configured so that the cylindrical support bar 36 is operable to "snap-fit" into the cylindrical tabs of each of the brackets 38.

Figure 7:
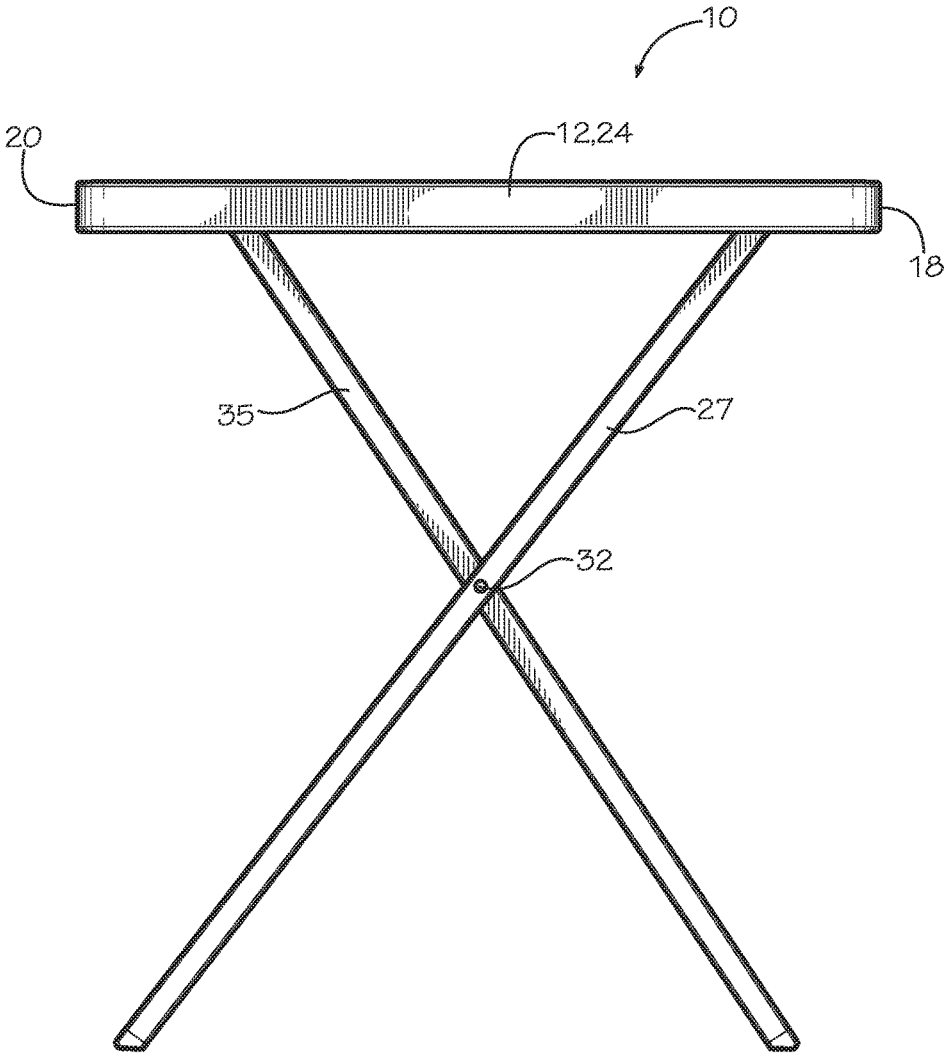
FIG. 7 is a left side elevation view of the collapsible table in the use position in accordance with one embodiment of the present disclosure.
Figure 8:
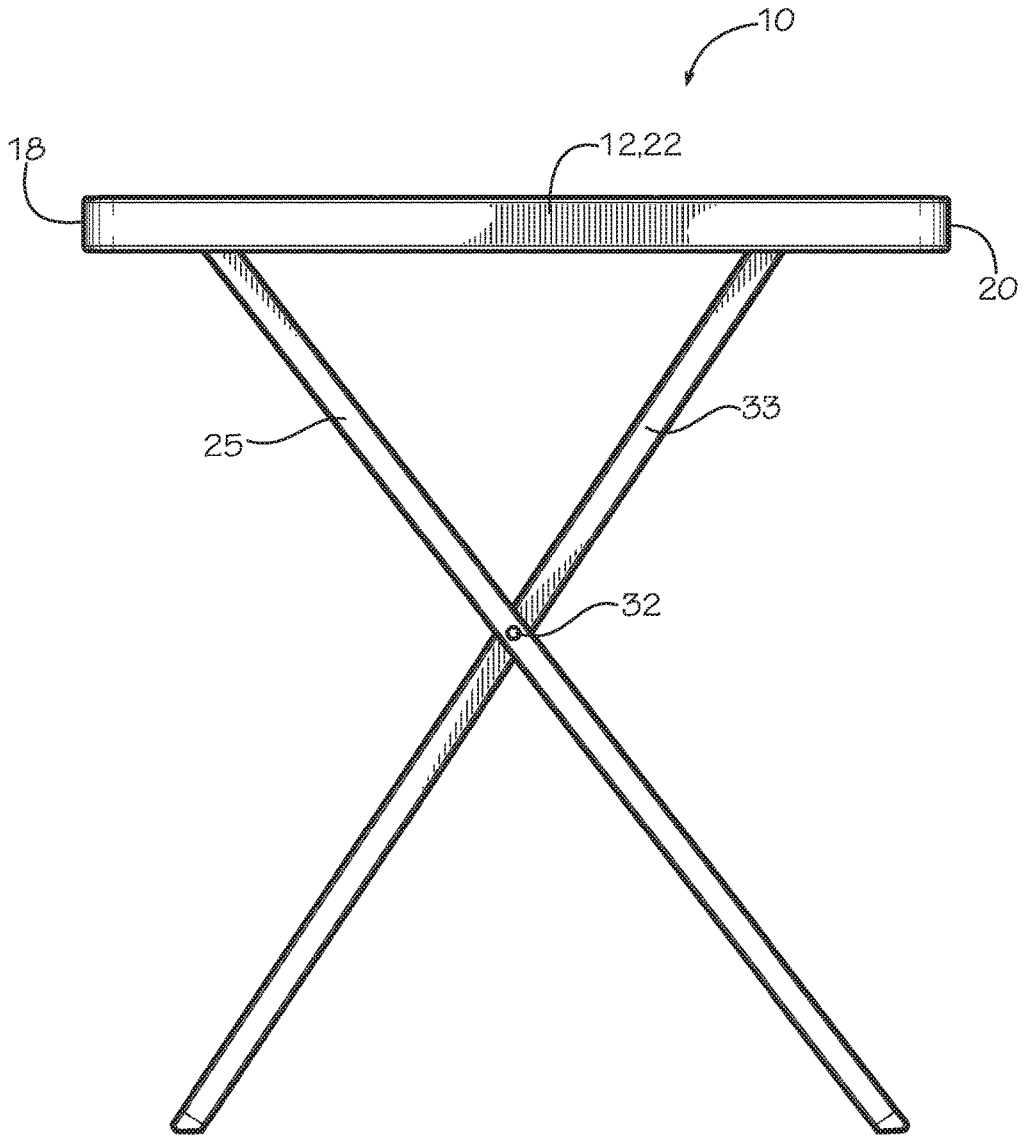
FIG. 8 is a right side elevation view of the collapsible table in the use position in accordance with one embodiment of the present disclosure.
Figure 9:
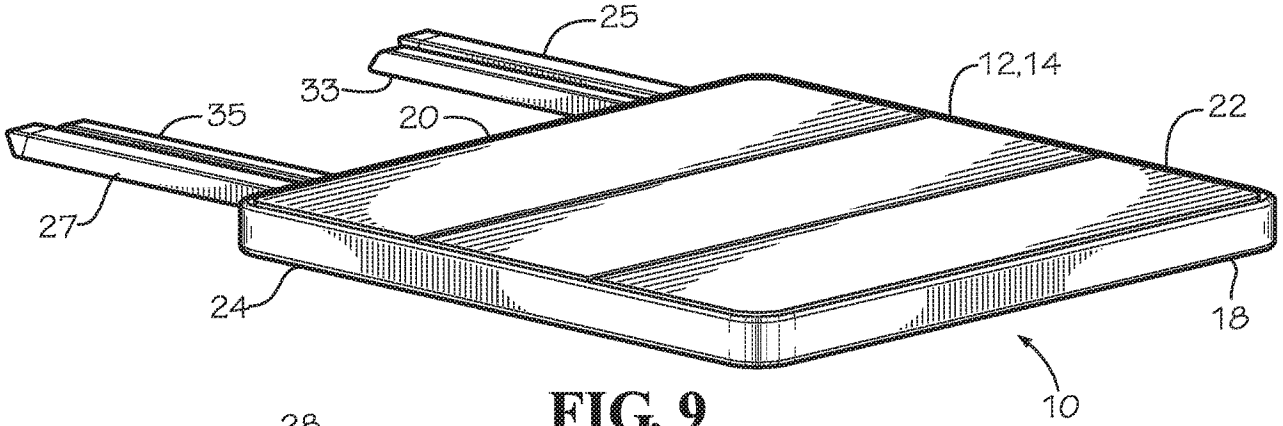
FIG. 9 is a top perspective view of the collapsible table in a storage position in accordance with one embodiment of the present disclosure.
Figure 10:
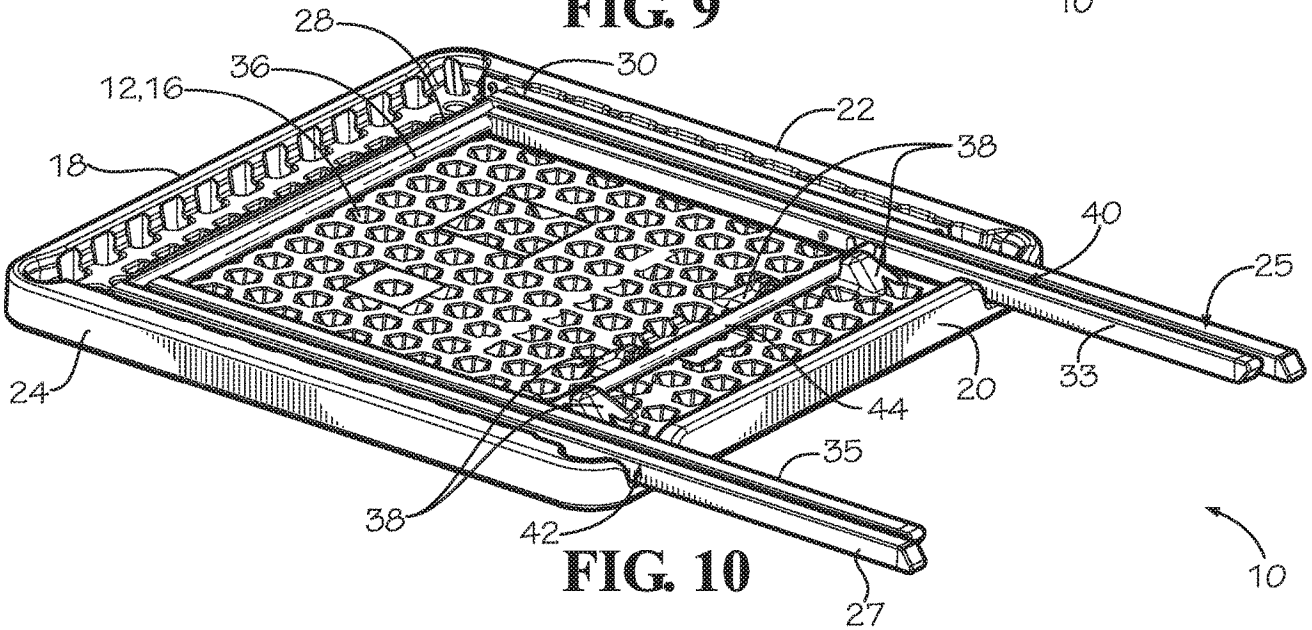
FIG. 10 is a bottom perspective view of the collapsible table in the storage position in accordance with one embodiment of the present disclosure.
Figure 11:
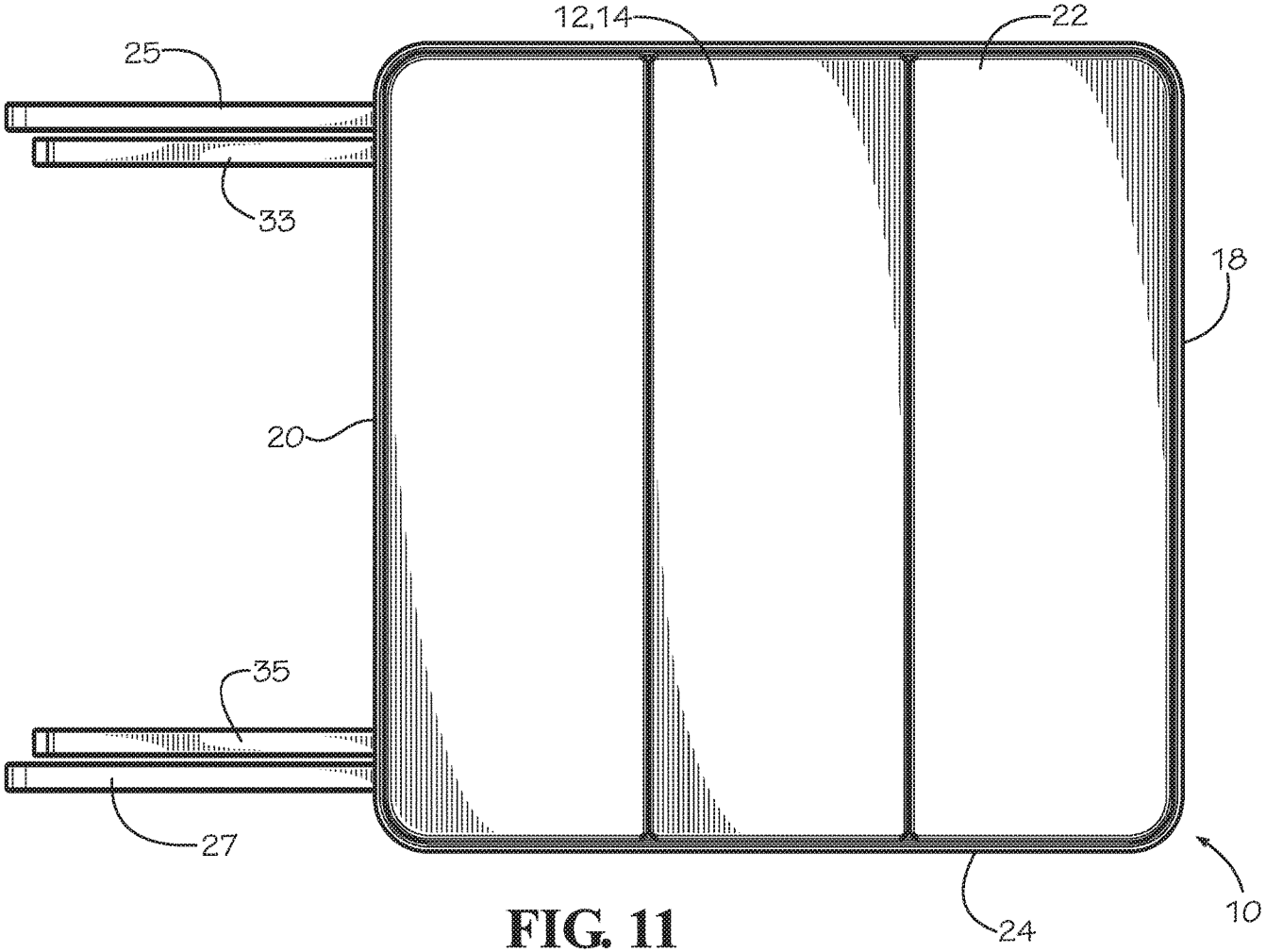
FIG. 11 is a top elevation view of the collapsible table in the storage position in accordance with one embodiment of the present disclosure.
Figure 12:
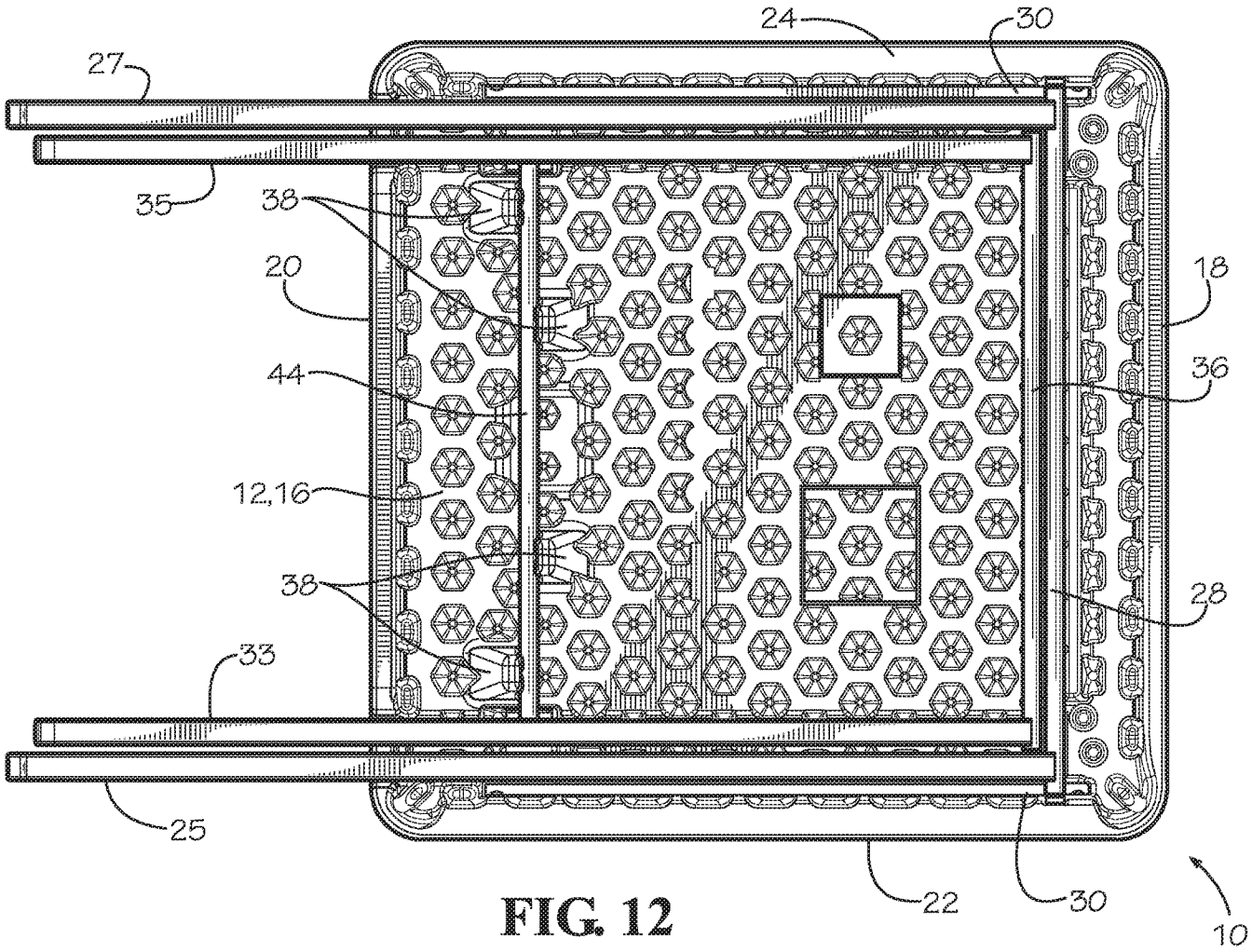
FIG. 12 is a bottom elevation view of the collapsible table in the storage position in accordance with one embodiment of the present disclosure.
Figure 13:
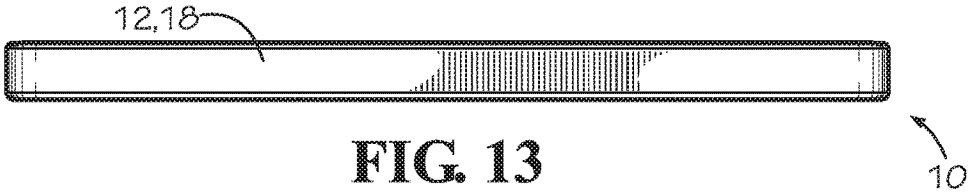
FIG. 13 is a front elevation view of the collapsible table in the storage position in accordance with one embodiment of the present disclosure.
Figure 14:
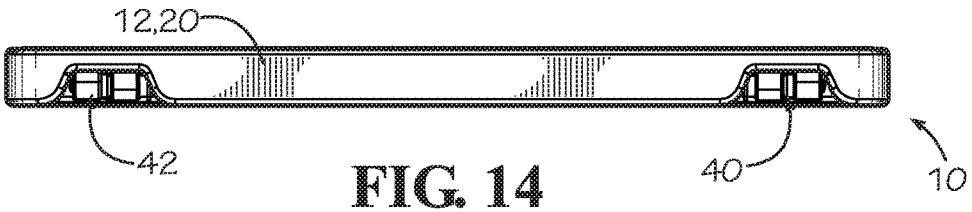
FIG. 14 is a rear elevation view of the collapsible table in the storage position in accordance with one embodiment of the present disclosure.
Figure 15:
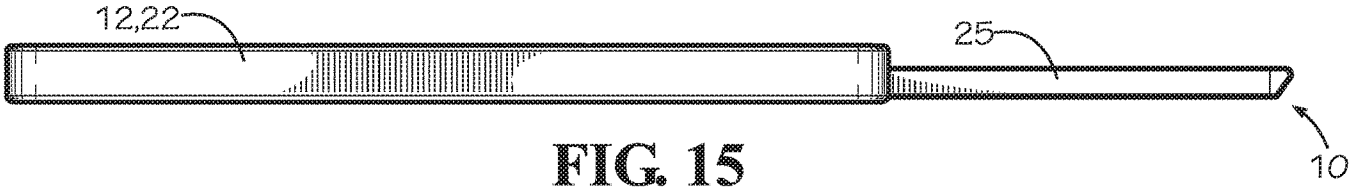
FIG. 15 is a left side elevation view of the collapsible table in the storage position in accordance with one embodiment of the present disclosure.
Figure 16:
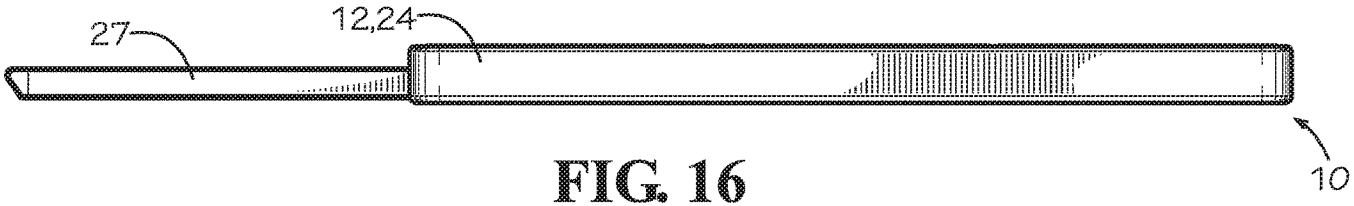
FIG. 16 is a right side elevation view of the collapsible table in the storage position in accordance with one embodiment of the present disclosure.
Figure 17:
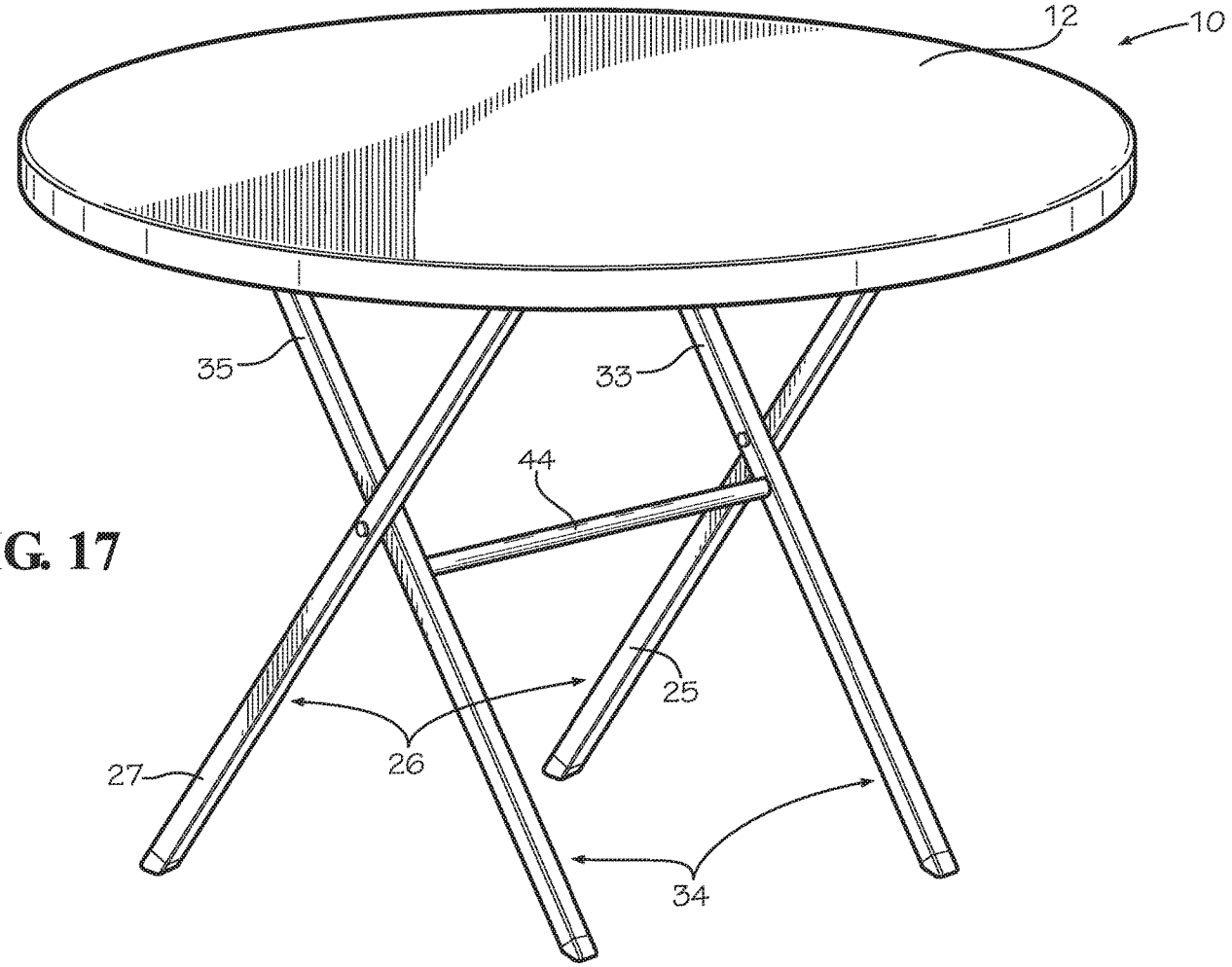
FIG. 17 is a top perspective view of a collapsible table in a use position in accordance with an alternative embodiment of the present disclosure.
Figure 18:
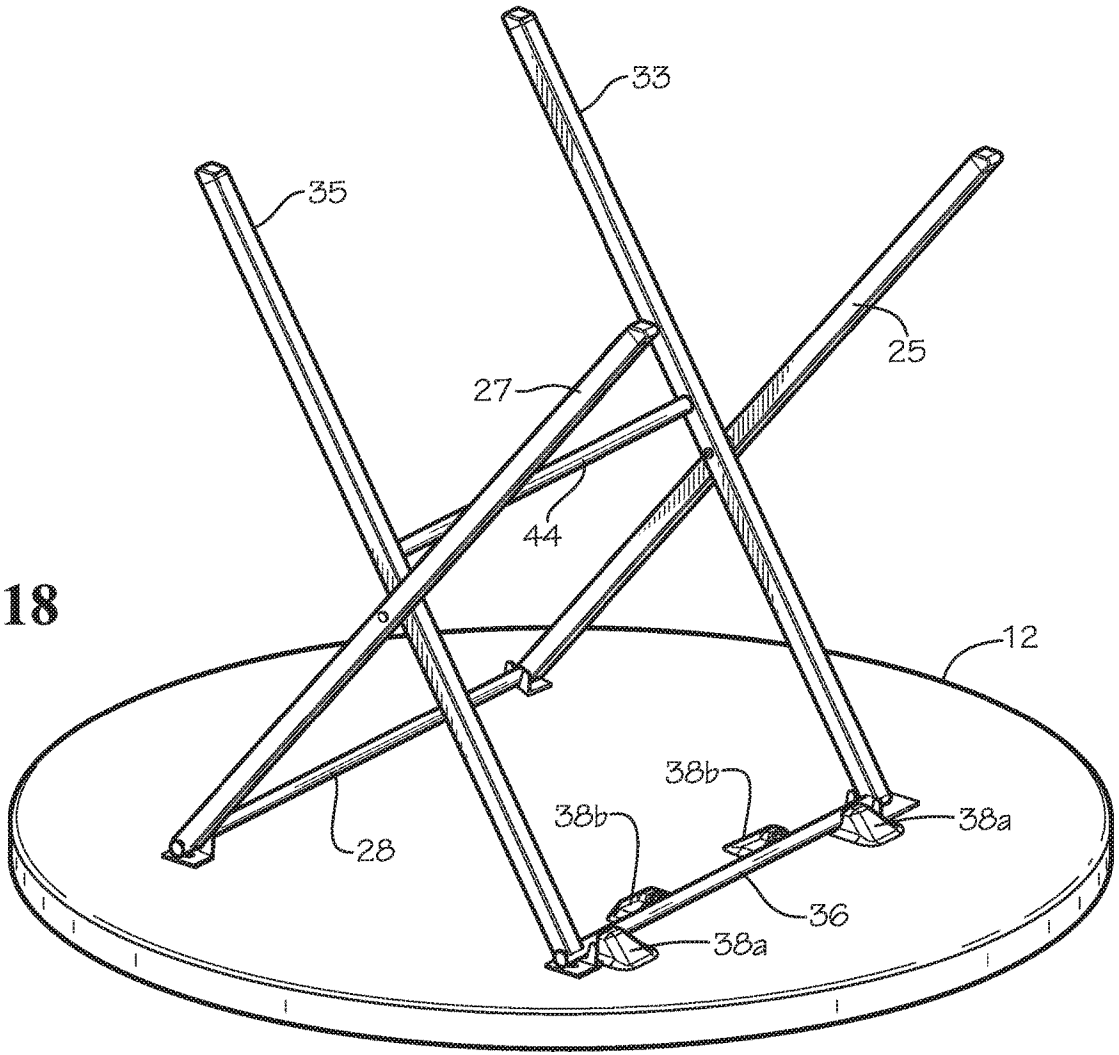
FIG. 18 is a bottom perspective view of the collapsible table in the use position in accordance with the embodiment depicted in FIG. 17.
Figure 19:
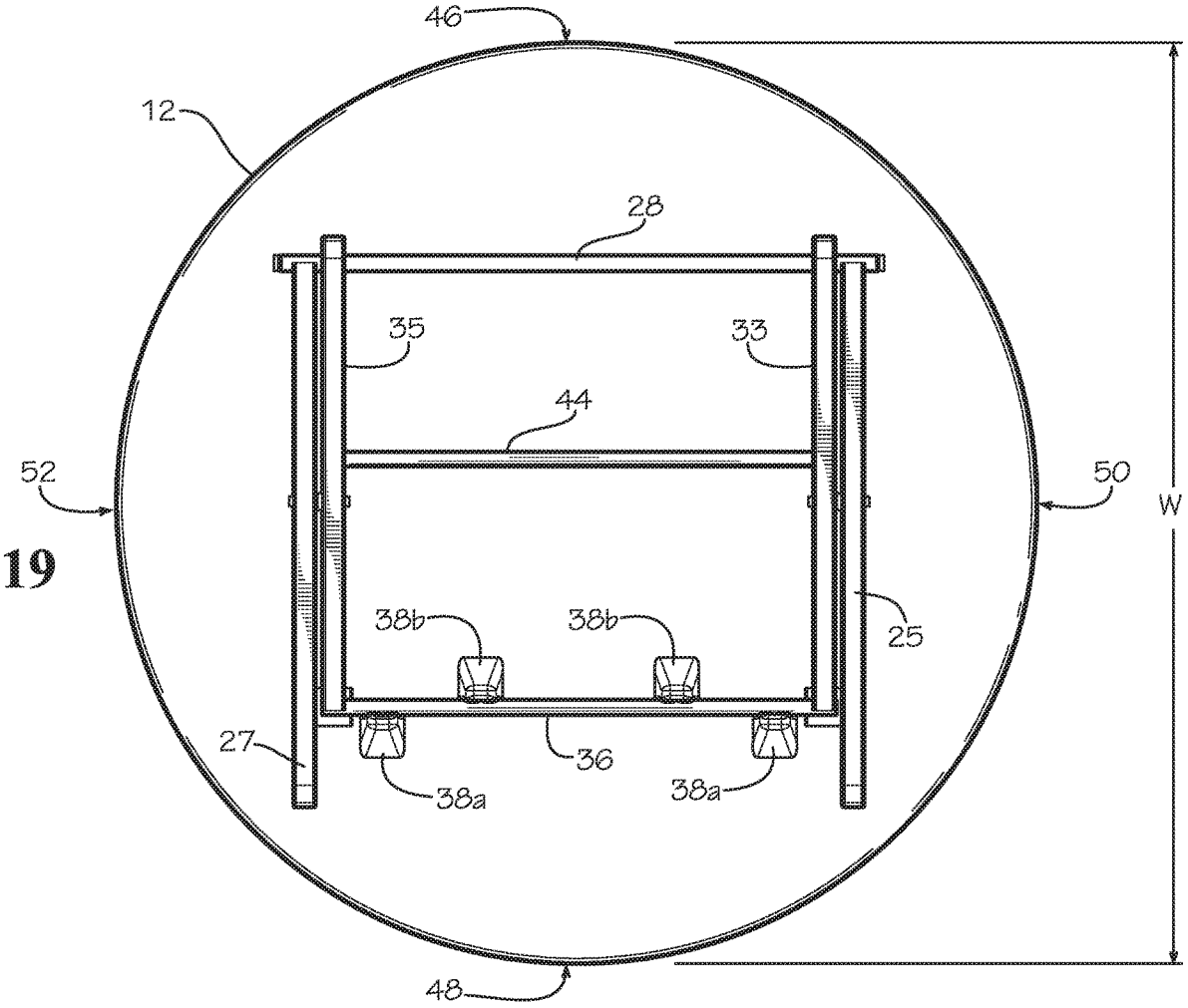
FIG. 19 is a bottom plan view of the collapsible table in the use position in accordance with the embodiment depicted in FIG. 17.
Figure 20:
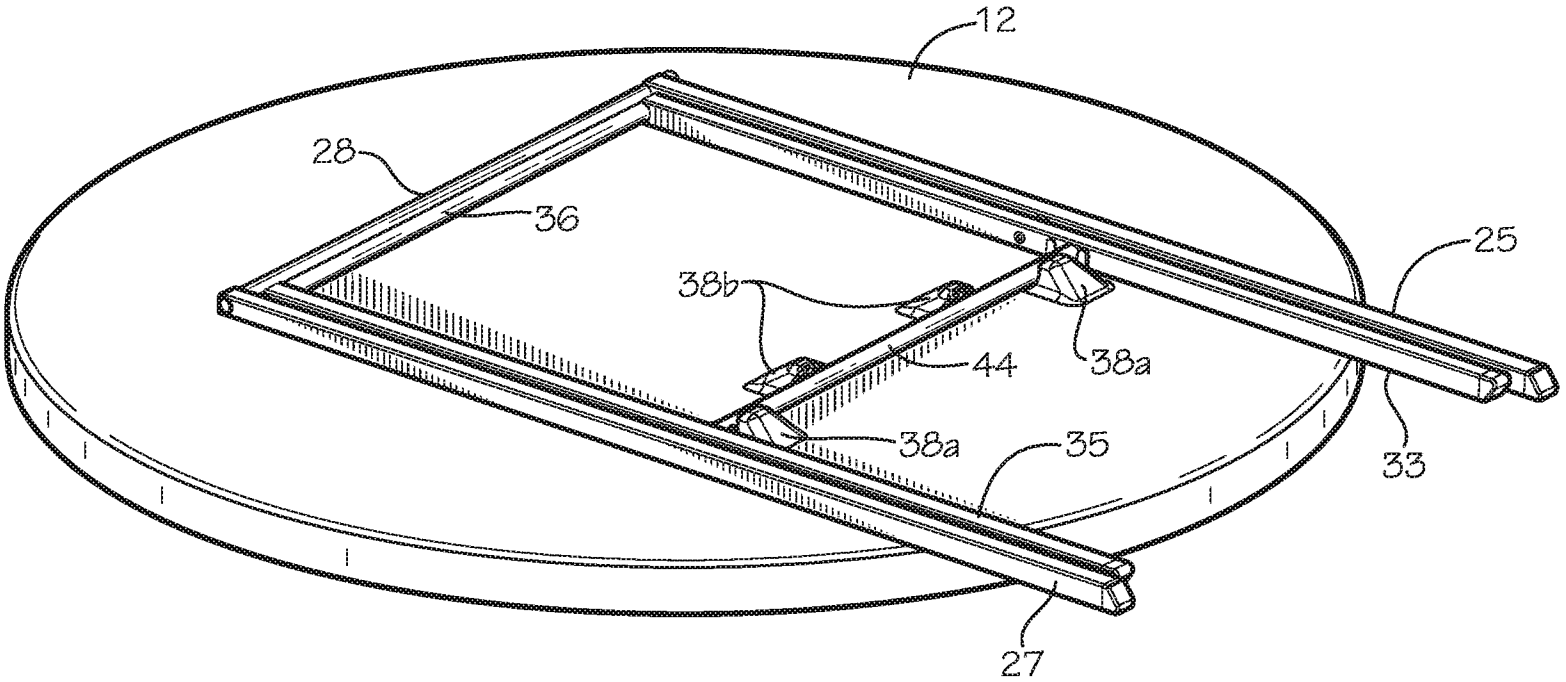
FIG. 20 is a bottom perspective view of the collapsible table in the storage position in accordance with the embodiment depicted in FIG. 17.
Figure 21:
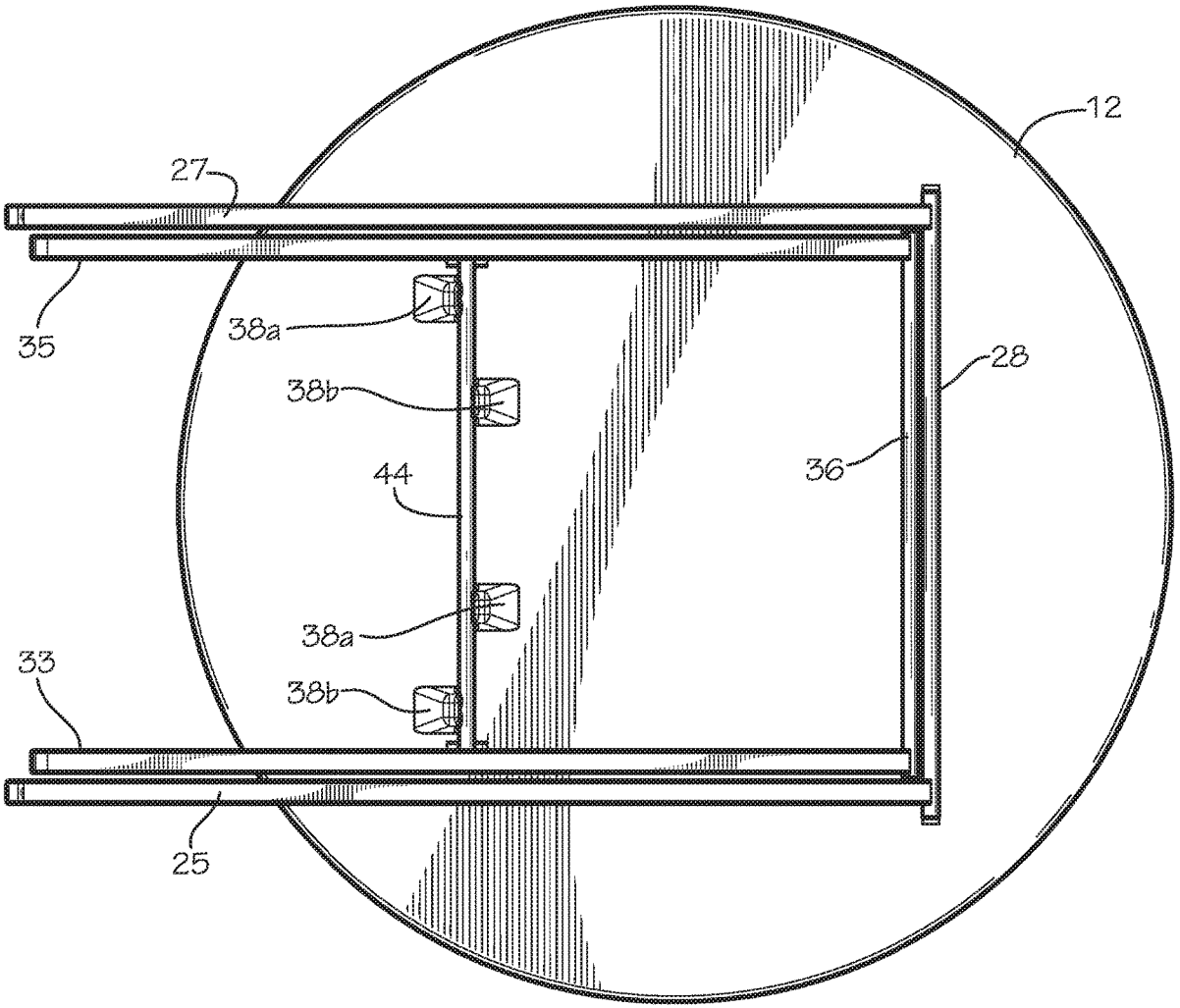
FIG. 21 is a bottom elevation view of the collapsible table in the storage position in accordance with the embodiment depicted in FIG. 17.

Referring to FIGS. 1, 7, and 8, the first pair of collapsible legs 26 are preferably pivotally cross-connected with the second pair of collapsible legs 34 using pivot members 32 that pivotally connect the first leg 25 to the third leg 33 and the second leg 27 to the fourth leg 35. Thus, when in the use position where the support bar 36 is received by the one or more brackets 38 and no substantial rotation of the support bar 36 is permitted, the first pair of collapsible legs 26 are also in a fixed position to provide a sturdily supported tabletop 12. However, when the support bar 36 is removed from the one or more brackets 38, the first pair of collapsible legs 26 and the second pair of collapsible legs 34 are operable to pivot relative to each other to move from the use position to the storage position. In the storage position, the legs are preferably all positioned substantially perpendicular to the ends 18 and 20 of the tabletop 12 (as best shown in FIGS. 9-10), and the support bar 36 is received within the bottom surface 16 of the tabletop 12 adjacent to the first end 18 and the support bar 28 (as best shown in FIG. 10). It is noted that, to permit the pivoting movement described above, the support bar 36 has a slightly smaller length than the support bar 28. As a result, the second pair of collapsible legs 34 are able to freely move within the space between the first pair of collapsible legs 26.

In preferred embodiments in which the length of the legs of the table 10 is greater than the width of the tabletop 12, as commonly occurs with respect to tables having a smaller surface area such as bistro tables, the second end 20 of the tabletop 12 includes a first receiving channel 40 and a second receiving channel 42. The first receiving channel 40 is positioned and configured for receiving a portion of the first leg 25 and the third leg 33 in their respective collapsed positions. The second receiving channel 42 is positioned and configured for receiving a top end portion of the second leg 27 and fourth leg 35 in their respective collapsed positions. For purposes of the present disclosure, the top end portions of the legs 25, 27, 33, and 35 are the portions of the legs that are disposed beneath the bottom surface 16 of the tabletop 12 in the storage position. Together, the first and second receiving channels 40 and 42 permit a flatter and more compact storage position by allowing the top end portions of the legs 25, 27, 33, and 35 to be received directly against the bottom surface 16 within the first end 18 and the second end 20 of the tabletop 12 with the bottom end portions of the legs extending out from the receiving channels 40 and 42.

To provide further support to the collapsible table 10, a support bar 44 is preferably provided that, like the support bar 36, secures the second leg 33 to the fourth leg 35. As shown best by comparing FIGS. 2 and 10, the support bar 44 is preferably positioned between the second leg 33 and fourth leg 35 such that it can be removably secured in the storage position to the same brackets 38 used to removably secure the support bar 36 in the use position. In other words, the support bar 44 connects the second pair of collapsible legs 34 to the bottom surface 16 of the tabletop 12 in the storage position via brackets 38 while the support bar 36 connects the second pair of collapsible legs 34 to the bottom surface 16 of the tabletop 12 in the use position via one or more of the same brackets 38. Removably securing the support bar 44 to the bottom surface 16 of the tabletop 12 provides a sturdier storage position in which the legs will only move when desired. Further, by removably securing the support bar 44 in the storage position to the same brackets 38 used to secure the support bar 36 in the use position, a more efficiently molded tabletop 12 is provided which has fewer molded parts.

The collapsible table 10 described above is believed to be best utilized with respect to tabletops and related surfaces having relatively small surface areas, such bistro tables, television trays, folding chairs, and stools, where the legs have a greater length than the width of the surface supported by the legs. Thus, while the present disclosure is described herein with respect to collapsible table 10, it should be understood that the disclosure could also be utilized with respect to another type of surface that is supported by collapsible legs, such as a tray, a chair seat, a stool seat, a bench seat, or a top platform of a stepladder.

FIGS. 17-21 depict an embodiment having a circular tabletop 12. The tabletop 12 of this embodiment has top and bottom surfaces, a first edge portion 46, a second edge portion 48 opposite the first edge portion 46, a third edge portion 50, and a fourth edge portion 52 opposite the third edge portion 50. As shown, the edge portions 46, 48, 50 and 52 comprise sections of the circular outer perimeter of the tabletop 12. The tabletop 12 has a width W.

The circular tabletop 12 includes a first set of brackets **38*a* and a second set of brackets 38*b* that are configured and function in the same manner as described above for the embodiment depicted in FIGS. 1-16. The brackets 38*a* and 38*b* are preferably formed from plastic and are integral portions of the bottom surface of the tabletop 12** formed during a blow molding process.

The legs 25, 27, 33 and 35 and the support bars 28, 36 and 44 of this embodiment are also configured and function in substantially the same manner as described above for the embodiment depicted in FIGS. 1-16.

The foregoing description of preferred embodiments for this invention have been presented for purposes of illustration and description. They are not intended to be exhaustive or to limit the invention to the precise form disclosed. Obvious modifications or variations are possible in light of the above teachings. The embodiments are chosen and described in an effort to provide the best illustrations of the principles of the invention and its practical application, and to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally, and equitably entitled.

What is claimed is:

1. A collapsible table comprising:

a tabletop having a width and comprising a top surface and a bottom surface opposite the top surface, wherein the top surface of the tabletop has a shape that is circular or elliptical;

a first pair of collapsible legs comprising a first leg having a top end portion, a second leg having a top end portion, the first and second legs having a length that is greater than the width of the tabletop;

a second pair of collapsible legs comprising a third leg having a top end portion, a fourth leg having a top end portion, the third and fourth legs having a length that is greater than the width of the tabletop, wherein the first and second pairs of collapsible legs are operable to move to a use position in which the legs extend from the bottom surface of the tabletop to support the tabletop, wherein the first and second pairs of collapsible legs are operable to move to a storage position in which at least the top end portions of each of the legs are disposed adjacent to the bottom surface of the tabletop;

a first support bar that is pivotally connected to the bottom surface of the tabletop and that connects the first leg to the second leg adjacent their top end portions;

a second support bar that connects the third leg to the fourth leg adjacent their top end portions;

a third support bar spaced apart from the second support bar that connects the third leg to the fourth leg; and a first pair of brackets disposed at a first location adjacent the bottom surface of the tabletop that removably secures the second support bar at the first location in the use position and that removably secures the third support bar at the first location in the storage position.

2. The collapsible table of claim 1 wherein the bottom surface of the tabletop includes:

a first receiving channel positioned and configured to receive the first leg and the third leg below their top end portions in the storage position; and a second receiving channel positioned and configured to receive the second leg and the fourth leg below their top end portions in the storage position.

3. The collapsible table of claim 1 wherein the tabletop is formed from blow-molded plastic.

4. The collapsible table of claim 3 wherein the first pair of brackets is integrally formed from the blow-molded plastic of the tabletop.

5. The collapsible table of claim 1 wherein the first pair of brackets receives a first portion of the second or third support bar, and the collapsible table includes a second pair of brackets at the first location that receives a second portion of the second or third support bar.

6. The collapsible table of claim 1 wherein the first pair of brackets is configured to prevent any substantial movement of the second and third support bars in the respective use and storage positions.

7. The collapsible table of claim 1 wherein the second pair of collapsible legs is pivotally connected to the first pair of collapsible legs.

8. The collapsible table of claim 1 wherein the first support bar is substantially non-removably secured to the bottom surface of the tabletop.

9. A collapsible supporting structure comprising:

a top structure having a width and comprising a top surface and a bottom surface opposite the top surface;

a first pair of collapsible legs comprising a first leg having a top end portion and a second leg having a top end portion, each of the top end portions of the first and second legs being pivotally connected to the bottom surface of the top structure, the first and second legs having a length that is greater than the width of the top structure;

a second pair of collapsible legs comprising a third leg having a top end portion, a fourth leg having a top end portion, the third and fourth legs having a length that is greater than the width of the top structure, wherein the first and second pairs of collapsible legs are operable to move to a use position in which the legs extend from the bottom surface of the top structure to support the top structure, wherein the first and second pairs of collapsible legs are operable to move to a storage position in which the legs are disposed flat against the bottom surface of the top structure;

a first support bar that connects the third leg to the fourth leg adjacent their top end portions;

a second support bar spaced apart from the first support bar that connects the third leg to the fourth leg; and one or more snap-fit brackets disposed adjacent the bottom surface of the top structure that removably secure the first support bar adjacent the bottom surface of the top structure in the use position and that removably secure the second support bar adjacent the bottom surface of the top structure in the storage position, wherein at least one of the one or more snap-fit brackets that secures the first support bar in the use position and at least one of the one or more brackets that secures the second support bar in the storage position are one and the same bracket.

10. The collapsible table of claim 9 wherein the top surface of the top structure has a shape that is one of rectangular, square, oval, elliptical, circular, and irregular.

11. The collapsible supporting structure of claim 9 wherein the top structure is one of a tabletop, a tray, a chair seat, a bench seat, a stool seat, and a step-ladder platform.

12. The collapsible supporting structure of claim 9 wherein the bottom surface of the top structure includes:

a first receiving channel positioned and configured to receive the first leg and the third leg below their top end portions in the storage position; and a second receiving channel positioned and configured to receive the second leg and the fourth leg below their top end portions in the storage position.

13. The collapsible supporting structure of claim 9 wherein the top structure is formed from blow-molded plastic.

14. The collapsible supporting structure of claim 13 wherein the one or more snap-fit brackets are integrally formed from the blow-molded plastic of the top structure.

15. The collapsible supporting structure of claim 9 wherein the one or more snap-fit brackets include:

a first set of brackets that receives a first portion of the first or second support bar; and a second set of brackets that receives a second portion of the first or second support bar.

16. The collapsible supporting structure of claim 9 wherein the one or more snap-fit brackets are configured to prevent any substantial movement of the first and second support bars in the respective use and storage positions.

17. A collapsible table comprising:

a tabletop having a width and comprising a top surface and a bottom surface opposite the top surface;

a first pair of collapsible legs comprising a first leg having a top end portion, a second leg having a top end portion, the first and second legs having a length that is greater than the width of the tabletop;

a second pair of collapsible legs comprising a third leg having a top end portion, a fourth leg having a top end portion, the third and fourth legs having a length that is greater than the width of the tabletop, wherein the first and second pairs of collapsible legs are operable to move to a use position in which the legs extend from the bottom surface of the tabletop to support the tabletop, wherein the first and second pairs of collapsible legs are operable to move to a storage position in which the legs are disposed flat against the bottom surface of the tabletop;

a first support bar that is pivotally connected to the bottom surface of the tabletop adjacent a first edge portion of the tabletop, the first support bar connecting the first leg to the second leg adjacent their top end portions;

a second support bar that connects the third leg to the fourth leg adjacent their top end portions;

a third support bar spaced apart from the second support bar that connects the third leg to the fourth leg; and at least one snap-fit bracket disposed on the bottom surface of the tabletop at a first location adjacent a second edge portion of the tabletop that is opposite and spaced apart from the first edge portion of the tabletop, the at least one snap-fit bracket for removably securing the second support bar at the first location in the use position and removably securing the third support bar at the first location in the storage position.

* * * * *